United States Patent [19]

Westdale et al.

[11] 4,430,403

[45] Feb. 7, 1984

[54] METHOD OF PREPARING A LITHOGRAPHIC PRINTING MASTER

[75] Inventors: Virgil W. Westdale, Barrington; James L. Hanrahan, Mt. Prospect, both of Ill.

[73] Assignee: AM International, Inc., Chicago, Ill.

[21] Appl. No.: 362,541

[22] Filed: Mar. 26, 1982

[51] Int. Cl.[3] ..... G03G 15/20

[52] U.S. Cl. ..... 430/49; 430/106.6; 430/122; 430/302

[58] Field of Search ..... 430/106.6, 49, 122, 430/108, 302

[56] References Cited

U.S. PATENT DOCUMENTS

| | | | |
|---|---|---|---|
| 3,345,294 | 10/1967 | Cooper | 430/903 |
| 3,907,562 | 9/1975 | Crystal | 430/49 |
| 4,082,681 | 4/1978 | Takayama et al. | 251/62.1 P |
| 4,189,390 | 8/1980 | Noguchi et al. | 430/903 |
| 4,218,530 | 8/1980 | Lu | 430/106.6 |
| 4,238,558 | 12/1980 | Ziolo | 430/108 |
| 4,251,616 | 2/1981 | Hendriks | 430/106.6 |
| 4,256,818 | 3/1981 | Blossey et al. | 430/106.6 |

*Primary Examiner*—John E. Kittle
*Assistant Examiner*—John L. Goodrow
*Attorney, Agent, or Firm*—Nicholas A. Camasto; Donald C. Kolasch

[57] ABSTRACT

A process of preparing a lithographic printing master is presented utilizing electrophotographic principles. As a result of the high density, low background images which can be developed using the disclosed novel developer composition, a high quality lithographic master can be fabricated. The novel developer composition comprises a low melt viscosity polyamide resin a magnetic oxide component and a conductive carbon pigment.

9 Claims, 2 Drawing Figures

METHOD OF PREPARING A LITHOGRAPHIC PRINTING MASTER

BACKGROUND OF THE INVENTION

This invention relates to an imaging system and, more specifically, to lithography.

Lithographic printing is a well-known and established art. In general, the process involves printing from a flat plate depending upon the difference in properties between image and non-image areas for printability. In conventional lithography, the non-image area is hydrophilic while the image is hydrophobic. A fountain solution is applied to the plate surface which wets all portions of the surface not covered by the hydrophobic image. This solution keeps the plate moist and prevents it from scumming up during the printing phase of the process. An oil-based printing ink is applied to the image surface, depositing the lithographic ink on the image area, the hydrophilic non-image area repelling the ink. The ink image may then be transferred directly to a paper sheet or other receptive surface, but generally it is transferred to a rubber offset blanket which, in turn, transfers the print to the final paper copy. Hence, for each print made during a run, the lithographic plate is first dampened with an aqueous fountain solution, inked with a lithographic printing ink and printed via an offset blanket onto the final receptive copy sheet.

It has been known that lithographic plates can be made electrophotographically by utilizing conventionally developed electrophotographic plates as lithographic printing masters. In these systems, usually a zinc-oxide type of plate is charged by conventional means and exposed to the image to be reproduced with the resulting electrostatic latent image developed with conventional electrostatic toner. The toner is generally hydrophobic in nature, as is the undeveloped background area of a conventional binder-type electrophotographic plate. In order that the developed plate be useful as a lithographic master, a differential must be established between the toner image and the background of the plate. Since both are hydrophobic in nature, it is necessary to treat the background of the electrophotographic plate by the use of a conversion solution so as to render the background surface hydrophilic in nature. After the alteration of the non-image, background area, a nonaqueous, oil-based ink can be used whereby the toner will accept the ink and the now hydrophilic background areas will repel the ink.

While these systems have been found useful for lithographic purposes, there are inherent disadvantages in their use. For example, in the preparation of a printing master, it is necessary, in order to produce final printed images of lithographic quality, that the developed electrophotographic image be of extremely high-quality copy with sharp images of high-image density and minimal background so that the master produced can withstand the vigors of the lithographic process over extended periods of usage, a lithographic system inherently being a high-volume printing process. In the heretofore used developer systems in preparing electrophotographic printing plates to be utilized in lithographic printing processes, the images formed have been found to be less than adequate to produce the results required in lithography. Poor quality images have led to deficient masters which produce relatively short periods of usage time. In addition, high background and poor image density have contributed to the deficiencies.

It is, therefore, an object of this invention to provide a lithographic printing system which will overcome the above and other disadvantages.

It is a further object of this invention to provide a novel method for the preparation of a lithographic printing master.

Another object of the present invention is to provide an imaging system utilizing a novel lithographic master prepared from an electrophotographic plate.

Still a further object of the present invention is to provide a novel lithographic printing plate utilizing electrophotographic principles.

Yet, still a further object of the present invention is to provide a lithographic printing plate prepared by an electrophotographic system wherein the master produced is of a high-quality image with low background and high-image density and sharpness.

The foregoing objects and others are accomplished in accordance with the present invention, generally speaking, by providing a lithographic printing plate prepared electrophotographically wherein a single component developer composition, hereinafter referred to as a developer toner, for developing electrostatic latent images, is utilized comprising a resinous component having a sharp melt point and low melt viscosity essential for heat fusing and exhibiting good melt-flow characteristics inclusive of superior wetting properties in a short dwell time, heat-fusing environment. For purposes of the present invention, polyamide resins were determined to be highly suitable for use as the single component toner resinous component due to the sharp melting point characteristics and low melt viscosity of the polyamide, which is essential for short residence time heat fusing. Included as a component of the polyamide toner composition is a magnetic oxide material, generally present in the toner composition in an amount of from 40 to 75 percent by weight of the instant developer composition. The resulting polyamide-magnetic oxide toner composition possesses excellent melt-flow characteristics in that it exhibits a sharp melting point and low melt viscosity and flows evenly so as to become congruous with the substrate. Since the subject resins have good melt-flow characteristics, they inherently possess the capability to desirably wet out the highly loaded magnetic oxide particles in the formulation. This wetting-out characteristic and relatively good melt-flow property of the toner is also attributed to the presence of the specific magnetic oxide selected since the magnetic oxide has good dispersing characteristics and plays an important role in the melt-flow mechanism. The developer toner further preferably includes a highly conductive carbon pigment to regulate the resistivity of the resulting toner particle.

It has been determined in the course of the present invention that lithographic printing masters may be fabricated electrophotographically so as to produce a master having an extremely sharp image with minimal background utilizing a single component developer composition or toner comprising a pigmented polyamide resin and a magnetic oxide component to develope the electrostatic latent image. The instant developer composition exhibits the necessary characteristics which permit the toner to be used in a pressureless, heat-fusing electrophotographic imaging process. The resulting printing masters fabricated are more durable with respect to normally encountered environmental conditions and handling without the toner images blocking or adhering to one another, for example, in or under normally used shipping conditions. Sharper melting type resins reduce cold flow tendency in that they do not tend to soften until the environmental temperature closely approaches the melting temperature. The utilization of the polyamide resin of the present invention will permit the formulation of a single component toner with a magnetic oxide content ranging from 40 to 75 percent by weight. The low melt viscosity property of the resin aids in the ability to fuse the toner adequately at surface-fusing temperatures of 215° to 225° F., at fusing rates of 3.8 inches per second. It is generally known that heat-fusible toners usually provide for a cleaner background since pressure-fusing rolls, heretofore used in conjunction with single component toners, tend to move the toner particles about on the surface supporting the electrostatic latent image, thus enlarging background particles as pressure is applied. The heat-fusible toners of the present invention are especially suitable for fabricating lithographic masters herein defined which are subsequently used for duplicating. The polyamide resins used in the process of preparing the printing master of the present invention provide for the required sharp melting point and low melt viscosity of 1,000 centipoises or less of the resinous constituent, thus providing the desirable melt-flow characteristics when used in combination with the magnetic oxide additive in developing the electrostatic latent image.

DETAILED DESCRIPTION OF THE INVENTION

Figure 1:
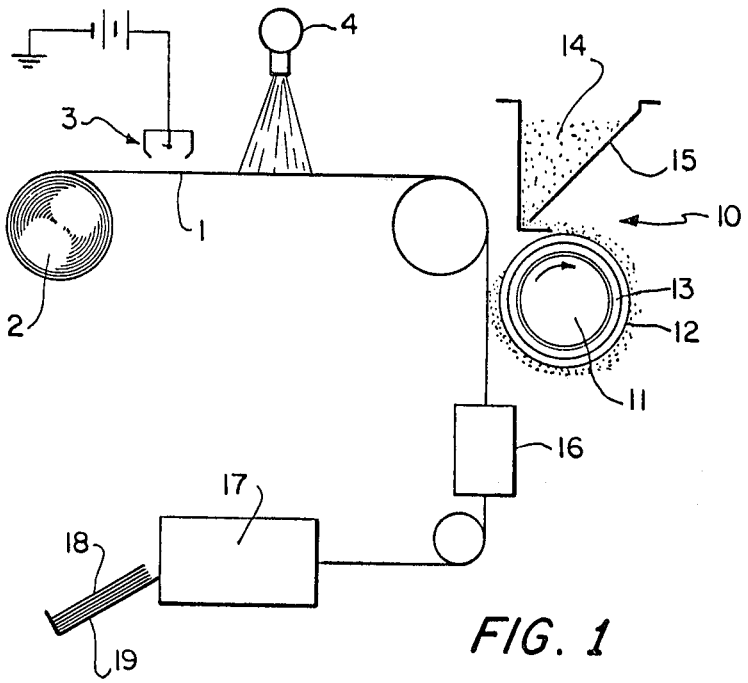
Figure 2:
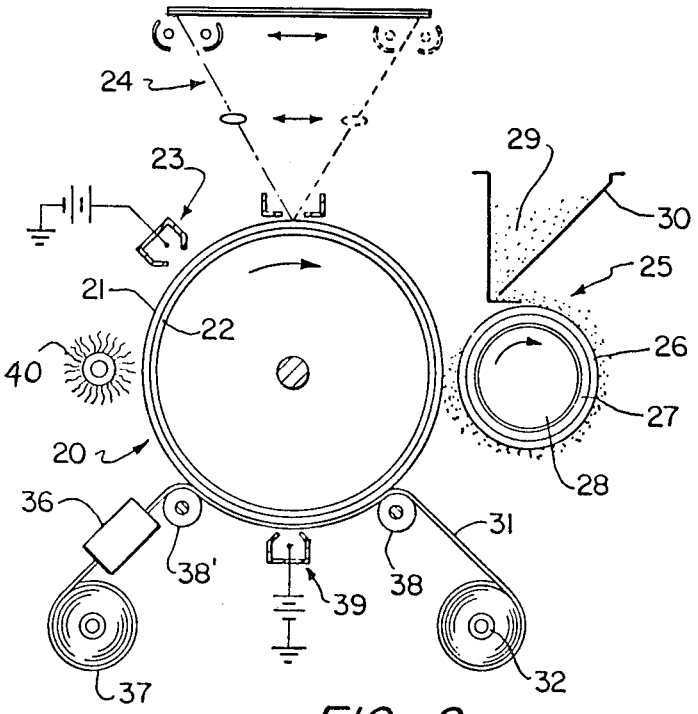

The invention is more specifically defined by way of the accompanying illustrations which are exemplary in nature and are not intended to limit in any way the scope of the present invention and wherein:

FIG. 1 represents a direct imaging system of preparing a lithographic printing master; and FIG. 2 represents a transfer imaging system of preparing a lithographic printing master.

Referring now to FIG. 1, there is seen an electrostatic copying apparatus adapted to utilize the developer toner composition of the present invention wherein a photoconductive substrate 1 such as zinc oxide paper is utilized which is to ultimately serve as the lithographic printing master. The photoconductive substrate is fed from a roller 2 and is uniformly electrostatically charged by a corotron unit 3. The charged zinc oxide paper substrate 1 is selectively exposed to electromagnetic radiation at station 4 to form an electrostatic latent image on the surface thereof. The imaged substrate moves past a development unit 10 comprising a magnetic roll 11 which rotates in a clockwise direction, as indicated by the arrow, within a stationary sleeve comprising an insulative nonconductive polymeric material 12 superimposed on a nonmagnetic metal layer 13. When in operation, the magnetic roll 11 rotates within the sleeve to transport the toner particles 14 fed from the toner dispenser 15 to the imaged member to develope the charged image areas thereof. The toner particles have a charge applied thereon opposite in polarity to that of the image.

The developer or toner powder provided comprises in at least a major part a polyamide resin having a sharp melting point within the range of about 70° to 165° C., preferably within the range from about 97° to 107° C., with a low melt viscosity. As used herein, the term "polyamide resin" refers to the polymerization product resulting from the condensation of polyamines with polybasic acids. In general, any polyamide resin produced according to the reaction set forth above may be used in the present invention, providing the melting point of the final resin composition is within the range specified, preferably 97° to 107° C. Below 70° C. there is a danger of the resin melting at the normal operating temperature of the electrophotographic apparatus, bearing in mind also that the toner composition must withstand high temperatures such that may be encountered during shipping without producing cold flowing which would have a detrimental effect upon the printing master. The sharp melting point polyamide resins reduce this cold flow tendency inasmuch as they do not soften unless the environmental temperature approaches very near to their melting temperature. Thus, the melt temperature of the polyamide resin utilized is maintained substantially above any shipping temperature which may be encountered. Temperatures above the upper limit generally will produce charring of the imaged copy masters, depending upon the residence time and are obviously undesirable.

Any suitable polyamide resin which satisfies the above requirements may be used in the course of the present invention. Typical polyamide resins are the Versamid 335, 712, 750, 930, 940 and 950, resins commercially available from Henkel Corporation, and Polymid P-1155, P-4771 and P-1074, commercially available from the Lawter Chemical Company. It should also be appreciated that polyamides having melting points outside the stated range, such as Polymid 1084, available from the Lawter Chemical Company, may be used if combined with other polyamides such that the final resin composition has the desired melting point. Thus, a Versamid 900 resin, which has a melting point of 180° to 190° C., or a Versamid 100 resin, which has a melting point of 43° to 53° C., may be combined with other polyamides such as the P-4771 resin, to produce a polyamide composition having a melting point within the operating range of 70° to 165° C. The low melt viscosity resins, such as the P-4771 resin, are preferred for their flow characteristics including a viscosity of 1,000 centipoises or less at their melting temperatures.

As referred to above, a highly conductive carbon pigment is added to the developer powder or toner in order to provide the particles with a surface coating which will render them somewhat conductive, so as to decrease the resistivity of the particle and enhance powder flow processing. Other pigment materials may be used in combination with the conductive carbon pigment in order to produce various desired effects. The carbon particles will generally have a size ranging from 12.0 to 22.0 millimicrons (m$\mu$) and will be added to the toner composition in an amount from about 0.5 to 4.0 percent, preferably 0.75 to 1.2 percent by weight based on the total weight of the toner. The conductive carbon is added to the toner or developer composition to impart thereto a resistivity ranging from 50 ohm-cm to $1\times10^5$ ohm-cm and preferably $1.0\times10^2$ ohm-cm to $1.0\times10^3$ ohm-cm to achieve the desired conductivity. Typical highly conductive carbon particles suitable for use in the preparation of the developer composition of the present invention include Columbian CC40-220, commercially available from the Columbian Chemicals Co., Vulcan SC-72R, commercially available from the Cabot Corp., and Printex L, commercially available from the DeGussa Corp.

Any suitable magnetic oxide component may be added to the resinous toner composition which imparts the desired effect to the single-component developer of the present invention. Typical magnetic oxide materials include $Fe_2O_3$, $Fe_3O_4$ and various forms of magnetite. The magnetic oxide component is present in the toner composition in an amount ranging from about 40 to 75 percent by weight, and preferably from about 50 to 70 percent, in order to produce sharp, well defined images on the master. In such formulations, the amount of polyamide resin present will range from about 60 to 25 percent by weight and preferably 40 to 30 percent, always allowing for the presence of the conductive carbon component for control of conductivity as described above.

The resulting developer or toner particles of the present invention are preferably classified so as to be present in the final developer composition in a size ranging from 8.0 to 40.0 microns, and preferably 12.0 to 35.0 microns in diameter. Particle sizes ranging from 6 to 8 microns may be present up to a maximum of 1 percent. It is preferred that at least 90 percent of the developer composition be comprised of particles ranging from 12 to 35 microns.

The developed image on the substrate 1 is fed to a fuser 16 wherein the toner image is fixed to the surface of the photoconductive substrate 1. The imaged substrate or master passes to processing unit 17 from which the final printing plate 18 is discharged into copy tray 19. The imaged plated 18 is used as a printing master by attaching to a lithographic printing press and, by way of the process steps discussed above with respect to the use of a conversion solution, fountain solution and lithographic printing ink, multiple copies of the imaged master reproduced.

Any suitable process may be used to prepare the developer composition or toner of the present invention. The polyamide resin may be mixed thoroughly with the conductive carbon pigment and magnetic oxide additives, both of which have been previously reduced to the desired particle sizes. For example, ferric oxide particles commercially available in sizes of 100 to 500 mμ and carbon black available in particle sizes of from 9.0 to 50 mμ may be used. The resulting mixture is heated to about 180° to 200° C. to melt the polyamide resin and to form a homogeneous melt which is blended and then allowed to cool and harden. At this point, the magnetic substance and carbon black, if present, have been distributed thoroughly and uniformly throughout the resin. The cold, hardened mix is then broken up and ground to reduce the material to a particle size of substantially about 8 to 40 microns, preferable 12 to 35 microns. In an alternate embodiment to the process above-described, the conductive carbon particles may be added to the polyamide-magnetic oxide blend, subsequent to the forming of the polyamide-magnetic oxide particles or additional carbon particles added to the original blend which effectively embeds the carbon in the surface of the toner particles in accordance with the process disclosed in U.S. patent application Ser. No. 362,534 filed simultaneously herewith and having a common assignee. The presence of the conductive carbon pigment decreases the resistivity of the resulting toner particles, thus substantially enhancing the performance of the single component toner system.

Referring now to FIG. 2, there is seen an electrostatic copying system adapted to utilize the developer composition of the present invention in a transfer mode wherein a cylindrical photoconductive drum, generally designated 20, made up of a reuseable photoconductive material 21, such as selenium, is coated on a support substrate 22. When in operation, the drum is rotated at a uniform velocity in a direction indicated by the arrow so that, after portions of the drum periphery pass the charging unit 23 so as to apply a uniform electrostatic charge thereto, the drum surface passes beneath the imaging mechanism 24, herein represented as a scanning system, or other means for exposing the charged photoconductive surface to the image to be reproduced. Subsequent to charging and exposing, sections of the drum surface move past a developing unit, generally designated 25. The developer apparatus 21 consists of a fixed non-magnetic sleeve comprising a cylindrical metal shell 27 and polymeric insulating layer 26 surrounding a rotatable magnetic roll 28. The magnetic roll comprises alternate north and south poles about its circumference. The magnetic field is uniform along the axial length of the magnet. A bias polarity is applied to the toner particles opposite to the polarity which the photoconductive drum is electrostatically charged. Toner particles of the present invention 29 are supplied to the unit 25 from a dispenser 30. The toner particles are rotated into contact with the imaged member while the magnetic roll 28 is rotated in a clockwise direction, as indicated. The image thus developed continues around until it comes into contact with a substrate, herein represented as a copy web 31 from feed roll 32, which is to serve as the master substrate and to be used as the printing master. The web 31 is passed up against the drum surface by two rollers 38 and 38' so that the web moves at the same speed as the periphery of the drum. The single component toner of the developer composition is periodically replenished. A transfer unit 39 is placed behind the web and spaced slightly therefrom between rollers 38 and 38'. This unit is similar in nature to the surface-charging mechanism 23 in that both operate on the Corona-discharge principle. It should be noted, however, that other transfer techniques may be utilized in conjunction with the present invention, such as adhesive transfer. After transfer of the toner image to the lithographic web master 31, the latter moves through the fixing unit 36 which serves to fuse or permanently fix the toner image to the master support. After passing the transfer station, the drum continues around and moves beneath the cleaning brush 40 which prepares the surface of the reuseable photoconductive member for a new cycle of operation. The masters prepared according to the process herein described are then stored on the take-up roll and can be selectively severed or cut from the roll when use is desired. Alternatively, the masters prepared need not be provided in the form of a roll or web, as herein described with respect to FIG. 2, but, in practice, may be provided in the form of singular master substrates which, more along the lines defined with respect to FIG. 1, can be separately stored upon discharge from the processing unit through which it is introduced after fusing the developed image.

Any suitable material may be used as the substrate for the lithographic master of the present invention, with the selection generally being governed by the type of system being used to prepare the master, whether it be in a direct imaging mode or a transfer imaging mode. If the master substrate is hydrophilic in nature, then it eliminates the necessity of utilizing a conversion solution so as to convert the background non-image areas to the desired hydrophilic properties. If, however, a hydrophobic member is implemented, such as a zinc oxide binder plate, then the conversion solution will be utilized so as to establish the necessary hydrophilic properties with respect to the background non-image areas to provide the necessary property differential between the image and non-image areas for the application of the oleophilic lithographic printing ink. Typical substrate materials include zinc oxide binder plates, organic photoconductive binder plates such as phthalocyanine photoconductors, conductive Mylar, photoconductive or conductive glass, conductive paper, as well as aluminum, brass and copper sheet material.

Any suitable wet-out or fountain solution may be used in the course of the present invention. Typical such fountain solutions are well known in the art, such as disclosed in U.S. Pat. No. 3,107,169. Typical fountain solutions are 1 percent solutions by volume of gum, cellulose and water, gum arabic and water, glycerol and water and isopropyl alcohol and water. The fountain solutions may contain other constituents, such as, for example, formaldehyde and it is desirable to add glycerine if it is not present, primarily to take advantage of its hygroscopic nature and, hence, by absorption of water, prolong the period during which the hydrophilic surface of the lithographic plate retains its hydrophilic properties. The formaldehyde additives will also produce this effect. Therefore, the fountain solutions containing the glycerine, formaldehyde additives or mixtures thereof are preferred inasmuch as the resulting lithographic plates can be kept before use for relatively long periods of time as compared to those plates treated with a fountain solution not containing the respective additive. Solutions containing gum arabic are also found to be very effective inasmuch as a lithographic plate treated with such a solution is found to retain its hydrophilic properties in the non-image areas for relatively long periods of time following removal from the printing press. As a result, the instant printing plate may be used and reused without subjecting it to additional treatment with a fountain solution.

Any suitable lithographic ink may be used in the course of practicing the present invention. Typical such lithographic inks and their properties are disclosed in "Printing Ink Technology" by E. A. Apps, Chapter 1, Chemical Publishing Company, Inc., New York, N.Y., 1959. The inks are of the same fundamental style as good-quality letterpress inks, and the simplest type consists of a pigment mixture dispersed in a lithographic varnish. The lithographic or oil-based ink, being oleophilic in nature, adheres to the hydrophobic toner image and is repelled by the hydrophilic non-image areas.

PREFERRED EMBODIMENTS

To further define the specifics of the present invention, the following examples are intended to illustrate and not limit the particulars of the present invention. Parts and percentages are by weight unless otherwise indicated. The examples are intended to illustrate various preferred embodiments of the present invention.

EXAMPLE I

A toner consisting of 25 parts of a polyamide resin P-4471 and 10 parts of a modified polyamide resin P-1084, both commercially available from Lawter Chemicals, Inc., 15 parts of a magnetic oxide MO 8029, commercially available from Pfizer, Inc., and 50 parts magnetic oxide MPB Std. D, commercially available from Indiana General, is prepared according to conventional melt blend techniques and the resulting particles size-classified to obtain a toner having a volume average particle size of about 12 to 35 microns. Conductive carbon pigment CC40-220 is added to the toner up to about 1 percent of the toner composition.

An electrostatic latent image is formed on the surface of a zinc oxide photoconductive substrate by conventional electrophotographic techniques, developed and the resulting imaged photoconductor master introduced into a fuser apparatus at a rate of about 3.8 inches/sec. for a period of time of about 3 sec. The surface fusing temperature reading for the toner measured in the range of from 215° to 225° F. The master plate is then wrapped on the cylinder of a lithographic printing press and operated in the conventional manner, first applying a conversion solution to alter the properties of the background non-image areas, followed by the application of a fountain solution using an ELFO desensitizer and acidic gum solution available from Azoplate Corporation. A lithographic ink is then applied to the printing surface of the plate and the ink image transferred in an image-wise configuration to a paper copy sheet via an offset blanket. High-quality images are obtained.

EXAMPLE II

The process of Example I is repeated with the exception that the MO-8029 magnetic oxide is replaced with MO-7029. The conductive carbon content of the toner composition was determined to be about 0.75 percent. The resulting plate produced high-quality images when used in a lithographic printing mode.

EXAMPLE III

The process of Example I is repeated with the exception that the MPB St'd. D magnetic oxide is replaced by 318 M magnetic oxide, commercially available from Mobay Chemical Corp. The conductive carbon content, in this instance Corax L, is measured to be about 1.5 percent. Similar results are obtained.

EXAMPLE IV

A toner consisting of 25 parts of polyamide resin P-3370 and 10 parts of modified polyamide P-1084 commercially available from Lawter Chemicals, Inc., and 65 parts magnetic oxide MO 7029, commercially available from Pfizer, Inc., was prepared in accordance with Example I and 1.25 percent XC-72R conductive carbon added thereto. The remainder of the process is substantially the same. Similar results were obtained.

EXAMPLE V

The process of Example I is repeated with the exception that polyamide resin P-4771 is replaced with the polyamide resin Versamid 940, commercially available from Herkel Corp. Similar results are obtained.

EXAMPLE VI

The process of Example I is repeated with the exception that the toner composition is altered to contain 29 parts of P-4471, 11 parts of P-1084, 14 parts of MO-8029 and 46 parts of MPB St'd. D. Similar results are obtained.

EXAMPLE VII

The process of Example I is repeated with the exception that the toner composition is altered to contain 21 parts P-4771, 9 parts P-1084, 16 parts MO-8029 and 54 parts MPB St'd. D. Similar results are obtained.

EXAMPLE VIII

The process of Example I is repeated with the exception that the electrostatic latent image is formed on a reuseable selenium photoreceptor and the image developed with the toner composition. The toner particles are then selectively transferred to a secondary support substrate comprising aluminized Mylar and fused thereto according to the fusing steps of Example I. The aluminized Mylar master is then strapped to a lithographic printing press and utilized as described in Example I. High quality images are produced from the printing master.

Although the present examples are specific in terms of conditions and material used, any of the above-listed typical materials may be substituted where suitable in the above examples with similar results being obtained. In addition to the steps used to prepare the lithographic printing plate of the present invention, other steps or modifications may be used utilizing the toner compositions of the present invention to provide other types of printing plates. For example, the process of the present invention and the specific toner compositions may be used if desired to prepare a xero printing master. A printing master prepared in this manner need only be charged and developed to reproduce copies of the original image, thereby eliminating the necessity of reimaging the printing plate. The entire process is one of electrostatics.

Anyone skilled in the art will have other modifications occur to him based on the teachings of the present invention. These modifications are intended to be encompassed within the scope of this invention and the following claims.

What is claimed is:

1. A process of preparing a lithographic printing master which comprises:

forming an electrostatic latent image on the surface of an electrophotographic lithographic member;

developing said latent image with a developer composition comprising a low melt viscosity polyamide resin having a melting point within the range of from about 70° to 165° C. and a melt viscosity of 1000 centipoises or less, a magnetic oxide component present in an amount ranging from about 40 to 75 percent by weight of said developer composition, and from about 0.5 to 4.0% of conductive carbon pigment imparting to said developer composition a resistivity ranging from 50 to $1\times10^5$ ohm-cm, said developer composition comprising developer particles ranging in size of from about 8 to 40 microns, with not more than 1 percent of the developer composition comprising particles having a size less than about 8 microns; and fixing said image to said member by the application of heat in the absence of pressure.

2. The process of claim 1, wherein said polyamide resin has a melting point within the range of from about 97° to 107° C.

3. The process of claim 1, wherein said magnetic oxide comprises magnetite.

4. The process as disclosed in claim 1, wherein 90 percent of said developer composition comprises particles ranging from 12 to 35 microns.

5. The process of claim 1, further including the step of transferring said developer composition in image-wise configuration from the surface of said electrophotographic member to a secondary lithographic substrate prior to the fixing of said image.

6. The lithographic printing plate prepared according to the process of claim 1.

7. The lithographic printing plate prepared according to the process of claim 5.

8. A method of making multiple copies from a lithographic printing plate which comprises applying to the surface of said lithographic printing plate of claim 6 a lithographic ink, said ink being distributed thereon conforming to said developed image in an image-wise configuration, contacting said inked surface with a copy sheet to thereby effect the transfer of an image to said copy sheet and repeating the inking and printing steps at least more than one time.

9. A method of making multiple copies from a lithographic printing plate which comprises applying to the surface of said lithographic printing plate of claim 7 a lithographic ink, said ink being distributed thereon conforming to said developed image in an image-wise configuration, contacting said inked surface with a copy sheet to thereby effect the transfer of an image to said copy sheet and repeating the inking and printing steps at least more than one time.

* * * * *